US005120112A

United States Patent [19]

Kincaid

[11] Patent Number: 5,120,112

[45] Date of Patent: Jun. 9, 1992

[54] VANE TYPE CONVEYOR FOR A MINING MACHINE DRUM

[75] Inventor: George J. Kincaid, Farmington, W. Va.

[73] Assignee: Tamrock World Corporation, N.V., Curacao, Netherlands Antilles

[21] Appl. No.: 670,299

[22] Filed: Mar. 15, 1991

[51] Int. Cl.[5] ..... E21C 35/20

[52] U.S. Cl. ..... 299/67; 37/189; 299/87; 299/89

[58] Field of Search ..... 299/64, 67, 68, 45, 299/46, 87, 89; 405/138; 37/92, 141 R, 189, 193

[56] References Cited

U.S. PATENT DOCUMENTS

| | | | |
|---|---|---|---|
| 2,665,655 | 1/1954 | Brown et al. | 37/189 X |
| 4,669,786 | 6/1987 | Morgan et al. | 299/76 |
| 4,871,213 | 10/1989 | Hanson | 299/64 |

FOREIGN PATENT DOCUMENTS

| | | | |
|---|---|---|---|
| 474209 | 8/1969 | Fed. Rep. of Germany | 299/89 |
| 856226 | 12/1960 | United Kingdom | 299/89 |
| 1110876 | 4/1968 | United Kingdom | 299/87 |

*Primary Examiner*—David J. Bagnell
*Attorney, Agent, or Firm*—Stanley J. Price, Jr.

[57] ABSTRACT

A continuous mining machine has a drum assembly rotatably supported thereon generally transversely to the axis of the mining machine frame. The drum member has a cylindrical outer surface supporting cutter bits for sumping into the mine face. Between the cutter bits are radially extending vanes for moving the mined material around the cutter drum assembly and for dissipating gases from the area adjacent to the cutter drum assembly.

11 Claims, 3 Drawing Sheets

VANE TYPE CONVEYOR FOR A MINING MACHINE DRUM

BACKGROUND OF THE INVENTION

1. Field of the Invention

This invention relates to a mining machine, and more particularly, to a continuous mining machine which includes vanes extending from the drum member of the boom assembly generally transversely to the axis of movement of the drum member rotation for moving the mined material rearwardly of the drum member and for dissipating gases adjacent the drum member.

2. Description of the Prior Art

In underground mining, it is well known to provide a continuous mining machine which includes a material dislodging member positioned on the front end of the mining machine for dislodging material from a mine face. The dislodged material is conveyed rearwardly of the mining machine by a conveying system positioned on the continuous mining machine. The continuous mining machine is designed to continuously advance and dislodge material being mined to form an entry or tunnel in the material seam. Various types of continuous mining machines having different types of cutting members as a material dislodging mechanism are known.

U.S Pat. No. 2,668,039 discloses a chain type cutter for dislodging material from a mine face with core breakers between the cutter chains and a material moving surface or vane extending between the cutter chains transversely to the direction of movement of the cutter chain assembly.

U.S. Pat. No. 2,729,002 discloses an excavating and loading machine utilizing a cutting wheel having axially extending vanes thereon which cut and transport the material being excavated onto a shield, positioned rearwardly of the cutting wheel, by means of centrifugal force maintaining the material being excavated against the blade of the cutting wheel.

U.S. Pat. No. 2,808,253 discloses a continuous mining machine having a rotating drum assembly with cutter bits extending therefrom supported on stationary housing sections. The drum sections have cutter bits extending from the surface thereof, and both the rotating drum sections and the stationary housing sections have core breakers, with the core breakers extending helically around the end drum sections.

U.S. Pat. No. 3,141,703 discloses a drum assembly rotatably supported upon a stationary housing. Helical auger flights on the end drum sections have cutter bits extending from the periphery thereof and direct the mined material inwardly of the end drum sections.

U.S. Pat. No. 3,860,291 discloses a continuous mining machine having a drum type dislodging mechanism with helical augers having cutter bits extending from the surface thereof. The augers move the mined material centrally of the cutter drum and onto a conveyor.

U.S. Pat. No. 3,892,443 discloses a continuous mining machine having a rotary drum with helical auger flights having cutter bits mounted on the periphery thereof. The auger flights are pitched to progress mined material toward the center of the drum assembly and onto a gathering device.

U.S. Pat. No. Re. 28,741 discloses a continuous mining machine with a rotating drum for dislodging material from a mine face. The cutter drum has helically extending augers or flights with cutter bits on the periphery thereof to dislodge material from the mine face and to move it centrally of the cutter drum onto a gathering head. The gathering head has a pair of counter-rotating discs with arcuate vanes having trailing edges to prevent binding of the gathered material between the vanes and other machine parts.

U.S. Pat. No. 4,346,939 discloses a mining machine having a drum type rotary material dislodging device with cutter bits extending from the surface thereof, and spiral vanes pitched to move the mined material centrally and onto a conveyor.

U:S. Pat. No. 4,428,619 discloses a series of fluid spray nozzles positioned on a cutter drum below the cutter bits to induce a flow of air around the cutter drum assembly which limits the egress of dust from the vicinity of the cutter drum head.

U.S. Pat. No. 4,465,318 discloses a series of water spray nozzles directing an air flow through openings in the material dislodging means to ventilate the working face of the mine from methane and other explosive mine gases.

U.S. Pat. No. 4,669,786 discloses a mining machine with a drum assembly for removing material from a mine face rotatably supported upon a continuous mining machine. The drum assembly has helically extending core breakers on the surface of each end drum section.

U.S. Pat. No. 4,871,213 discloses an excavator for use with breaking and removing material from an upright face of material to be mined. The rotary cutting head includes a series of radially directed continuous vanes which spiral inwardly in opposite directions from the outer ends of the drum assembly toward the center of the cutting head. The spiral vanes are connected to radially extending vanes or plates which are angled slightly relative to the longitudinal axis of the cutter head.

Although the prior art discloses helically extending vanes for removing material from a mine face and progressing the material toward the center of the drum assembly, and although the prior art discloses cutter drum assemblies with axially extending vanes for moving the mined material over the cutter drum assembly, there remains a need for a cutter drum assembly having radially extending vanes with trailing edges for moving the mined material around the cutter drum assembly without binding.

There also remains a need for a cutter drum assembly with radially extending flexible vanes to increase the effective length of the vanes while preventing the vanes from interfering with the sumping action of the cutter bits and increasing the effectiveness of the vanes in moving mined material and dissipating methane and other gases adjacent the mine face.

SUMMARY OF THE INVENTION

In accordance with the present invention, there is provided a continuous mining machine for use in an underground mine which includes a mobile frame assembly, a material dislodging means extending from the frame assembly, a conveying means having a conveying reach and a return reach, and appropriate controls and motors for operating the continuous mining machine.

The material dislodging means is a drum type dislodging mechanism rotatably supported transversely to the longitudinal axis of the continuous mining machine. Cutter bits extend from the outer cylindrical surface of the cutter drum for removing material from a mine face.

The cutter drum has vanes extending radially from the outer cylindrical surface of the cutter drum assembly for moving mined material over the cutter drum assembly and rearwardly thereof. The vanes extend between the cutter bits on the drum assembly, and also assist in dissipating gases adjacent the cutter drum assembly. The cutter drum assembly is operable, with modification of the position of the cutter bits, to rotate in opposite directions. The vanes are arcuate, with the end portions of the vanes flexed over and rearwardly of the base portion of the vanes to form trailing edges directed away from the direction of rotation of the cutter drum to enhance the ability of the vanes to move material over and rearwardly of the cutter drum assembly without binding.

In another embodiment of the present invention, the vane end portions on the outer cylindrical surface of the cutter drum assembly may be flexible such that the vane end portions extend to the distal ends of the cutter bits to enhance the gas-dissipating and material moving properties of the vanes without interfering with the sumping action of the cutter bits.

Accordingly, the principal object of the present invention is to provide a continuous mining machine which includes a cutter drum assembly having vanes with trailing edges extending radially therefrom for moving material over the cutter drum assembly and rearwardly therefrom without binding.

Another object of the present invention is to provide a continuous mining machine with a cutter drum assembly having vanes with flexible end portions extending radially therefrom for efficiently moving mined material over and rearwardly of the cutter drum assembly and dissipating gases collecting in the area adjacent the mining machine drum assembly without interfering with the sumping action of the cutter bits.

These and other objects of the present invention will be more completely disclosed and described in the following specification, the accompanying drawings and the appended claims.

DESCRIPTION OF THE PREFERRED EMBODIMENTS

Figure 1:
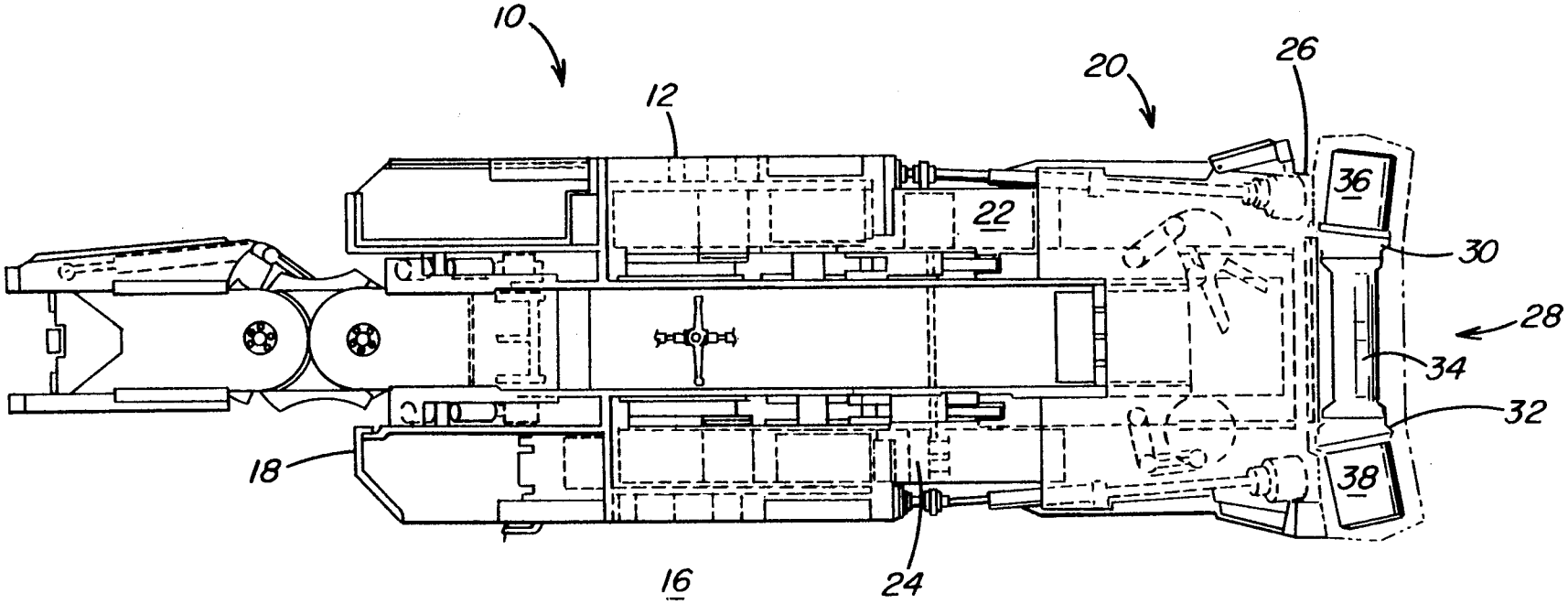
FIG. 1 is a top plane view of a self-propelled continuous mining machine with the drum assembly projecting from a boom assembly at the forward end thereof.

Referring to the drawings, and particularly to FIG. 1, there is illustrated a continuous mining machine generally designated by the numeral 10 for use in underground mining to dislodge material from a mine face. Continuous mining machine 10 includes a mobile frame assembly 12 and a pair of ground engaging traction means positioned at each side of the mobile frame assembly 12 for propelling mining machine 10 within a mine along the floor 16 thereof.

Continuous mining machine 10 is capable of being operated from an operating station in a manner similar to other such machines to dislodge material from a mine face and transport it rearwardly of the rear end 18 of mining machine 10. Accordingly, mining machine 10 includes operating controls and sources of power for operating ground engaging traction means and other equipment included thereon.

Mining machine 10 includes a boom assembly generally designated at 20 having a first end section 22 secured to the front end 24 of mobile frame assembly 12. Boom assembly 20 also includes a second end section 26. As seen in FIG. 1, a material dislodging head generally designated at 28 is connected to boom assembly 20 second end section 26. Mining machine head 28 is rotatably supported upon boom assembly 20 front end 26 by forwardly projected housing assemblies 30 and 32. Housing assemblies 30 and 32 rotatably support drum assembly 28 and project into an opening between the intermediate drum section 34 and the end drum sections 36 and 38. End drum sections 36 and 38 are canted relative to intermediate drum section 34 to form an opening between each adjacent end drum section 36 and 38 and intermediate drum section 34 to accommodate the projections 30 and 32 from the boom assembly 20 for rotatably supporting the dislodging head 28.

Figure 2:
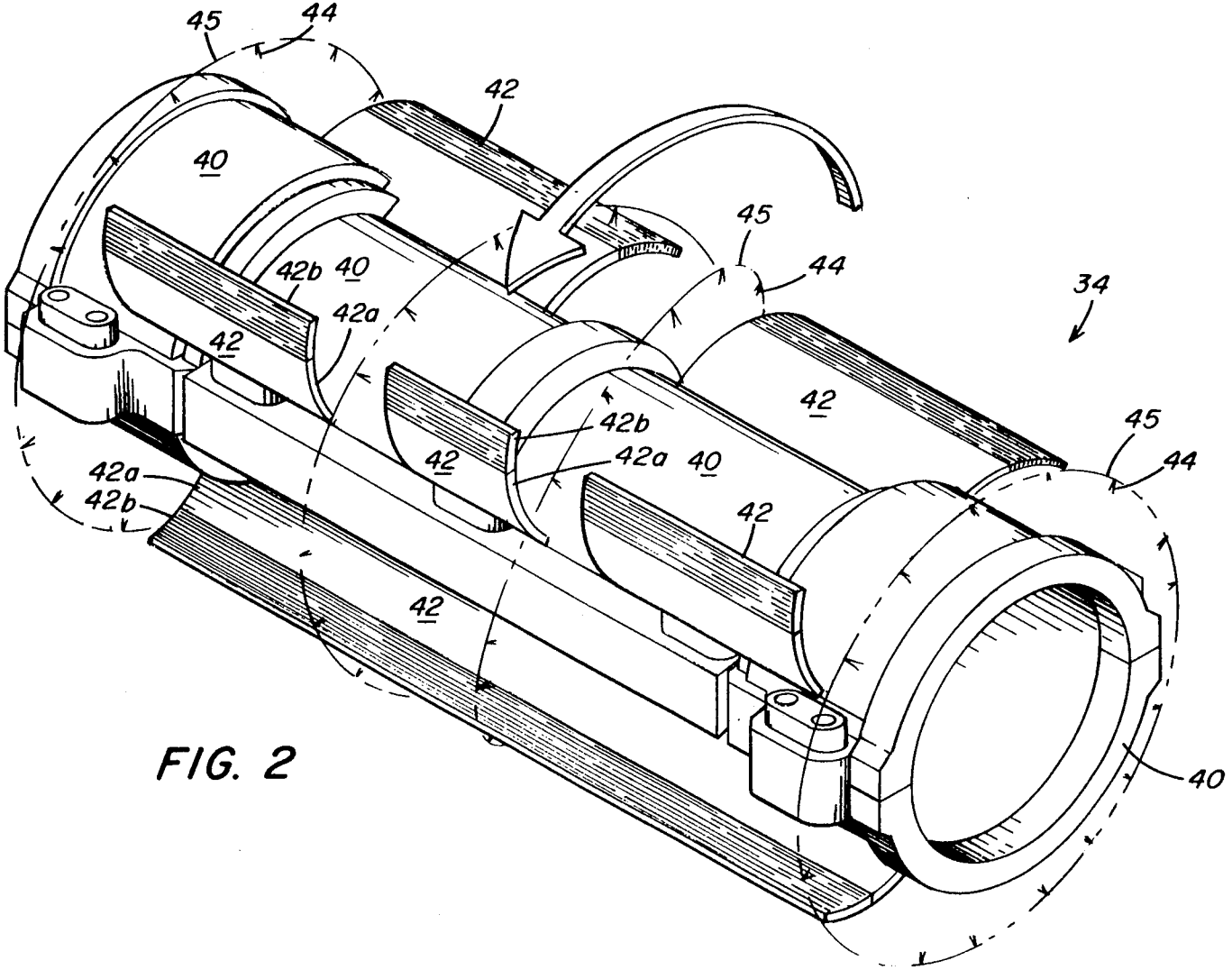
FIG. 2 is a perspective view of the drum assembly intermediate section and illustrating the vanes with trailing edges which extend between the cutter bits on the housing of the intermediate drum section.

Referring now to FIG. 2, there is illustrated intermediate drum section 34 in greater detail. Intermediate drum section 34 housing 40 is rotatably connected to housing assemblies 30 and 32. Intermediate drum section 34 has radially extending vanes 42 nonrotatably connected to the housing 40 of intermediate drum section 34. Intermediate drum section 34 housing assembly 40 has cutter bits 44 extending from the surface thereof above the end wall 46 of vanes 42 as illustrated by the dot dash line 45 which is the outer limit of cutter bits 44. The direction of rotation of the drum sections 34, 36 and 38 is reversible with the result that mined material removed by the cutter bits 44 may be transported over the top of the drum assembly 28 or conveyed beneath it by reversing the direction of rotation of material dislodging head 28. Before reversing the direction of rotation of material dislodging head 28, the cutter bits 44 must be reoriented on the outer cylindrical surface of the dislodging head 28.

Vanes 42, which extend radially from the outer cylindrical surface of the intermediate housing section 40 of the drum assembly 28 engage mined material and move the mined material dislodged from the mine face by the cutter bits 44 in the direction of rotation of the cutter drum assembly 28. Vanes 42 also function as a fan by moving air in the direction of rotation of the cutter drum assembly 28, and thus assist in dissipating methane and other gases from the vicinity of the cutter drum assembly 28. Vanes 42 are arcuate and have a base portion **42*a* connected to the housing assembly 40, and an end portion 42*b* spaced from the base portion 40*a*. As illustrated in FIG. 2, base portion 42*a* is positioned in advance, relative to the direction of rotation of housing 40, of end portion 42*b*, which is curved behind base portion 42*a* to form a trailing edge of vane 42. The trailing edge of vane 42 enables the vane 42 to move mined material over dislodging head 28 without binding of the dislodged material between vanes 42 and other mechanical parts of mining machine 10**.

When the direction of rotation of cutter drum assembly 28 is reversed after reorientation of cutter bits 44, the vanes 42 act as scoops or shovels to move mined material over cutter drum assembly 28, or beneath cutter drum assembly 28 depending upon their orientation.

Mined material is held against vanes 42 by centrifugal force.

Figure 3:
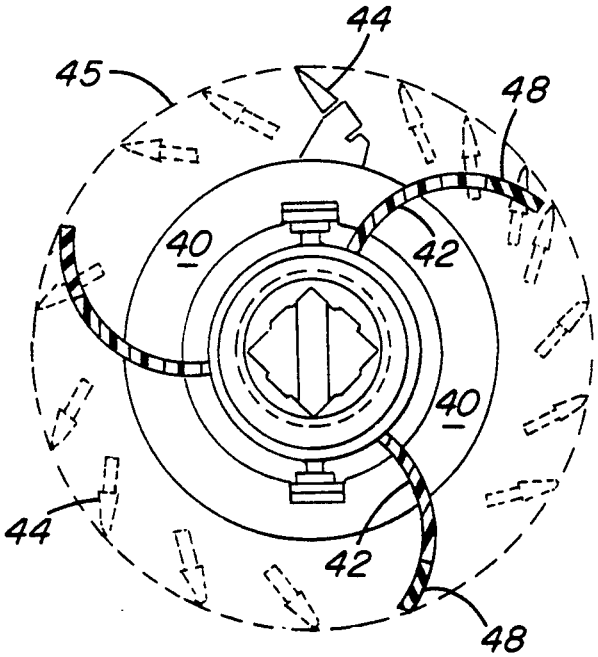
FIG. 3 is a view in side elevation showing the length of the cutter bits relative to the length of the vanes extending from the outer cylindrical surface of the intermediate drum assembly and illustrating the vanes with flexible end portions.

In the embodiment of FIG. 3, the vanes 42 have flexible end portions 48. Flexible end portions 48 increase the effective length of vanes 42 and brush against the mine face while preventing interference of the vanes 42 with the sumping action of cutter bits 44. In this manner, cutter bits 44 may operate to sump the full depth of the mine face without interference from the vanes 42 limiting the depth of sumping action of the cutter bits 44. By providing flexible end portions 48 on the vanes 42, the ability of the vanes 42 to transport mined material is enhanced, as is the ability of vanes 42 to dissipate methane and other gases and to provide ventilation to the area adjacent to the mine face.

According to the provisions of the Patent Statutes, I have explained the principal, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A continuous miner comprising:

a mobile frame assembly having a front end portion and a rear end portion, a boom assembly extending from said mobile frame assembly and having a first end portion connected to said mobile frame assembly and a second end portion rotatably supporting a cutter drum assembly, said cutter drum assembly having a surface with cutting means extending from the cutter drum surface to dislodge material from a mine face, said cutter means having a distal end spaced from said cutter drum surface and a proximal end adjacent to said cutter drum surface, said cutter drum assembly having a plurality of radially extending vanes projecting from said cutter drum surface between said cutter means and across the length of said cutter drum, said vanes each having a base portion and an end portion, said base portion being connected to said cutter drum surface, said end portion extending closely adjacent to the outer limit of the cutting path of said cutter means to engage the material as the material is dislodged from the mine face to enhance the movement of the dislodged material from the mine face, and said end portion being arranged at an angle relative to said base portion and having a vane trailing edge.

2. The continuous miner as set forth in claim 1 in which, said end portion of each of said vanes having a flexible end portion.

3. The continuous miner as set forth in claim 2 in which, said vanes each having a length from said base portion to said end portion approximately equal to the distance from said distal end of said cutting means to said surface of said drum assembly.

4. The continuous miner as set forth in claim 1 in which, said vanes extend outwardly from said surface on said drum assembly a distance less than the distance from said distal ends of said cutting means to said surface of said drum assembly.

5. The continuous miner as set forth in claim 1 in which, said vanes extend from said base portion in a direction from said cutting means surface opposite to the direction of rotation of said cutter drum assembly to said vane trailing edge, and said vane trailing edge is curved behind said base portion.

6. A continuous miner comprising:

a mobile frame assembly having a front end portion and a rear end portion, a boom assembly extending from said mobile frame assembly having a first end portion connected to said mobile frame assembly and a second end portion rotatably supporting a cutter drum assembly, said cutter drum assembly having a surface with cutting means extending from the surface of said cutter drum for dislodging material from a mine face, said cutter drum assembly having vanes extending from the surface of said cutter drum assembly between said cutting means to closely adjacent the mine face during the material dislodging operation to enhance movement of the material rearwardly from the mine face as the material is being dislodged, and said cutter drum assembly operable to rotate in either direction.

7. The continuous miner as set forth in claim 6 in which, said vanes having a base portion and an end portion, said base portion being connected to said cutter drum surface and said end portion being spaced from said base portion, and said end portion being arranged at an angle relative to said base portion and having a vane trailing edge.

8. A continuous miner comprising, a mobile frame assembly having a front end portion and a rear end portion, a boom assembly extending from said mobile frame assembly having a first end portion connected to said mobile frame assembly and a second end portion rotatably supporting a cutter drum assembly, said cutter drum assembly having a surface with cutting means extending from the surface of said cutter drum for dislodging material from a mine face, said cutter drum assembly having vanes extending from the surface of said cutter drum assembly between said cutting means, said cutter drum assembly operable to rotate in either direction, said vanes each having a base portion and an end portion, said base portion being connected to said cutter drum surface and said end portion being spaced from said base portion, and said vane member end portion having a flexible end portion.

9. A continuous miner comprising:

a mobile frame assembly having a front end portion and a rear end portion, a boom assembly extending from said mobile frame assembly and having a first end portion connected to said mobile frame assembly and a second end portion rotatably supporting a cutter drum assembly, said cutter drum assembly having a surface with cutting means extending from the cutter drum surface for dislodging material from a mine face, said cutter means having a distal end spaced from said cutter drum surface and a proximal end adjacent to said cutter drum surface, said cutter drum assembly having a plurality of radially extending vanes projecting from said cutter drum surface between said cutter means, said vanes each having a base portion and a flexible end portion, said base portion being connected to said cutter drum surface and said end portion being spaced from said base portion, and said end portion being arranged at an angle relative to said base portion and having a vane trailing edge.

10. The continuous miner as set forth in claim 9 in which, said vanes each having a length from said base portion to said end portion approximately equal to the distance from said distal end of said cutting means to said surface of said drum assembly.

11. The continuous miner as set forth in claim 9 in which, said vanes extend outwardly from said surface on said drum assembly a distance less than the distance from said distal ends of said cutting means to said surface of said drum assembly.

* * * * *